United States Patent [19]

Spinnler

[11] Patent Number: 4,893,589

[45] Date of Patent: Jan. 16, 1990

[54] WATER COOLING SYSTEM FOR A SUPERCHARGED INTERNAL-COMBUSTION ENGINE

[75] Inventor: Fritz Spinnler, Arisdorf, Switzerland

[73] Assignee: BBC Brown Boveri AG, Baden, Switzerland

[21] Appl. No.: 218,909

[22] Filed: Jul. 14, 1988

[30] Foreign Application Priority Data

Aug. 3, 1987 [CH] Switzerland ..... 2964/87

[51] Int. Cl.[4] ..... F01P 1/06

[52] U.S. Cl. ..... 123/41.31; 123/41.09; 123/41.29; 123/41.51

[58] Field of Search ..... 123/41.09, 41.29, 41.31, 123/41.49, 41.51, 559.1

[56] References Cited

U.S. PATENT DOCUMENTS

| | | | |
|---|---|---|---|
| 2,070,094 | 2/1937 | Schjolin | 123/196 AD |
| 2,556,327 | 6/1951 | Hild | 123/41.45 |
| 3,994,633 | 11/1976 | Shaffer | 418/5 |
| 4,325,219 | 4/1982 | Stang et al. | 60/599 |
| 4,608,827 | 9/1986 | Hasegawa et al. | 123/41.31 |
| 4,620,509 | 11/1986 | Crofts | 123/41.31 |

FOREIGN PATENT DOCUMENTS

| | | |
|---|---|---|
| 1128702 | 4/1962 | Fed. Rep. of Germany . |
| 2603462 | 3/1982 | Fed. Rep. of Germany . |
| 3407521 | 3/1985 | Fed. Rep. of Germany . |
| 2349731 | 11/1977 | France . |
| 834090 | 5/1960 | United Kingdom . |

*Primary Examiner*—Noah P. Kamen

*Attorney, Agent, or Firm*—Burns, Doane, Swecker & Mathis

[57] ABSTRACT

In a water cooling system for an internal-combustion engine supercharger by means of mechanical supercharger, main cooling circuit for the engine (1) and secondary cooling circuit for the supercharged (9) are operated with the same coolant and are cooled in a joint radiator (2), but in separate compartments, in order to ensre the independence of the respective operating temperatures. An ejector (10), driven by coolant from the main cooling circuit, delivers the secondary medium. The system is suitable in particular for spiral compressors which are provided on the outside with cooling ribs which protrude into externally mounted water chambers.

12 Claims, 2 Drawing Sheets

WATER COOLING SYSTEM FOR A SUPERCHARGED INTERNAL-COMBUSTION ENGINE

BACKGROUND OF THE INVENTION

1. Field of the Invention

The invention relates to a water cooling system for an internal-combustion engine supercharged by means of a mechanical supercharger. The system includes a main circuit, substantially consisting of water pump, and a secondary circuit, substantially consisting of a radiator and an internal-combustion engine, which operate with the same coolant.

2. Discussion of Related Art

Such cooling systems with pump circulated cooling are common today in automotive engineering. In such systems, the heat loss from the internal-combustion engine is removed by water, which is then cooled in the radiator. The radiator size is determined, inter alia, by the quantity of heat to be removed, whereby the quantity of heat loss due to the installation of the mechanical supercharger has to be taken into consideration.

Either a radiator can be provided for the supercharger, or, where possible, a direct interconnection with the main water circuit can be effected. With the latter option, housing and lines are saved. Moreover, there is a dependence on the temperature of the coolant. This temperature is set with regard to rapid reaching and constant maintenance of the operating temperature.

SUMMARY OF THE INVENTION

Accordingly, an object of the invention is to provide a secondary circuit in a system of the type mentioned above in the Field of the Invention so that it the secondary circuit functions independently of the temperature of the coolant in the main circuit, so that there is the possibility of cooling or heating up the mechanical supercharger at will.

According to the invention, this is achieved by the fact that the coolant is driven in the secondary circuit by a delivery device which is fed from the main circuit, preferably downstream of the pump, and that this coolant is cooled in a compartmentalized part of the radiator arranged in the main circuit.

An advantage of the invention is to be seen in particular in that only one cooling unit is required, and no separate drive, for example a conventional electric pump, has to be provided for the secondary circuit. The concept is consequently inexpensive, in particular if an ejector is provided as a delivery device, which in the case of the envisaged application can be a simple plastic injection molding.

If the radiator is a downdraft radiator, it is particularly expedient if the compartmentalization in the radiator is carried out by means of partitions in the upper and lower radiator tanks and if a compensating orifice is provided in the partition of the lower radiator tank. The partitions can then be injection-molded with the same mold, as integral parts of the radiator tanks. During filling of the cooling system, the secondary circuit is filled via the compensating orifice. Even when there is a considerable expansion of the coolant in the secondary circuit, the coolant can escape through the compensating orifice.

For setting the temperature of the working medium in the secondary circuit it is advantageous if a bypass line with a controlled thermostat valve is arranged parallel to the radiator. Such an arrangement makes it possible, for example, to heat up, instead of to cool, the supercharger in the part-load range of the internal-combustion engine.

If the mechanical supercharger is a machine of spiral design, the water cooling is particularly effective if the charge air is to be cooled considerably. Such a solution is known from DE 26 03 462 C2. In that document, cooling chambers are disclosed that communicate via a connecting line and that can be connected via a connection line to a cooling circuit. The cooling chambers are formed on the housing parts, in the space left free by the inner sections of the displacers or of the delivery spaces.

Nevertheless, there is no space available for accommodating cooling chambers inside superchargers which are provided with a central drive shaft for the spiral rotor. If the water chambers are therefore arranged at the two front ends of the supercharger, the side walls of the stationary spiral housing, which bound the delivery spaces, are advantageously provided with ribs. These ribs protrude into the water chambers, thereby considerably increasing the heat exchange surface. The most direct heat flow is achieved by arranging the ribs in the extension of the webs, bounding the delivery spaces, of the fixed spiral housing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
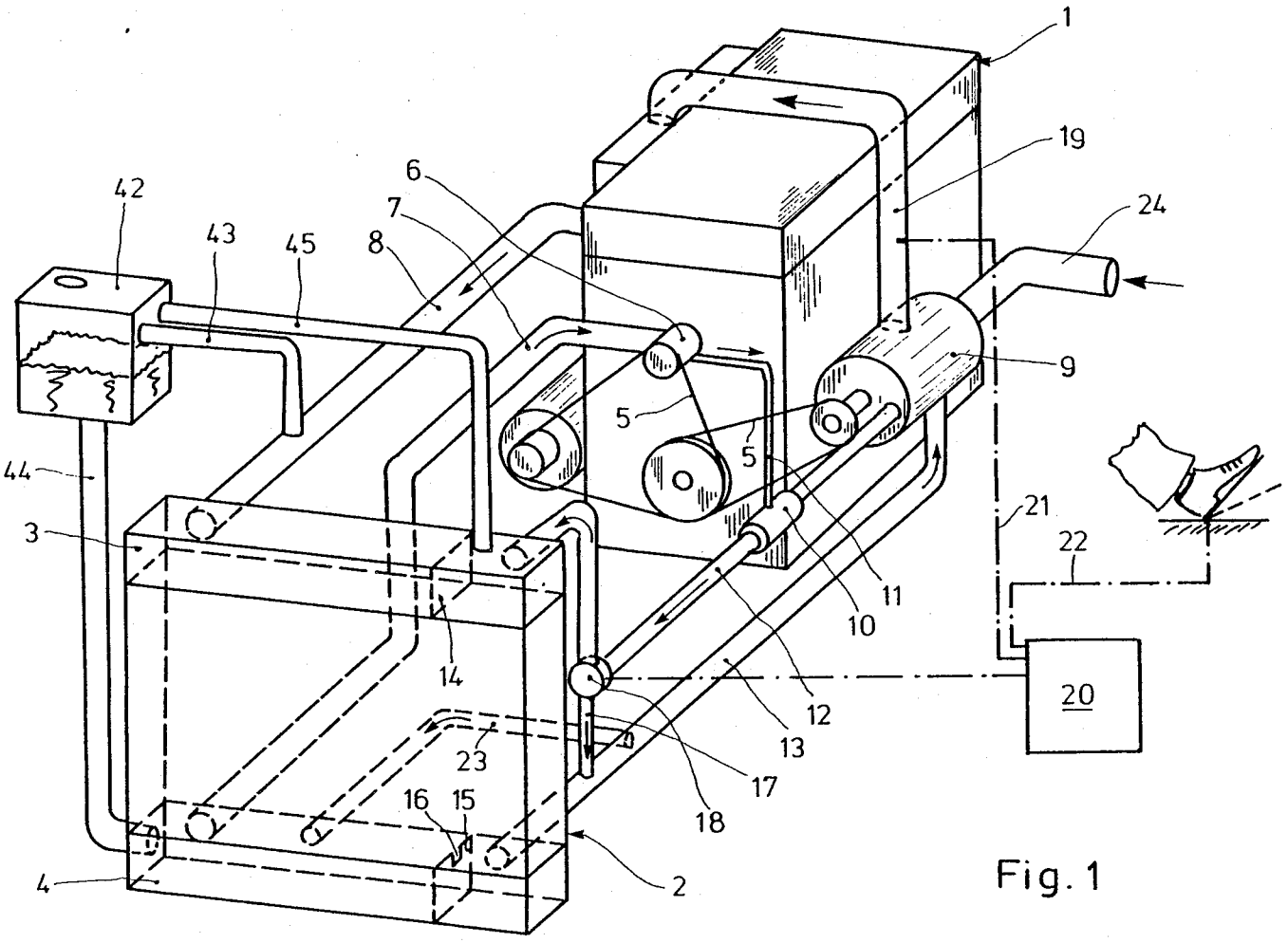
FIG. 1 is a diagrammatic view of the structure of a radiator system.

Referring now to the drawings, wherein like reference numerals designate identical or corresponding parts throughout the several views, the internal-combustion engine 1, shown in FIG. 1, is assumed to be a diesel engine or a 4-stroke gasoline engine. Only the parts which are of significance for an understanding of the invention are shown. The directional flow of the various working media is shown by arrows.

The heat given off at the combustion chamber walls of the engine is removed to the ambient air by water cooling. The radiator 2 required for this is assumed to be a downdraft radiator with vertical water flow from the upper radiator tank 3 to the lower radiator tank 4. An expansion tank 42 is connected to the lower radiator tank 4 via a filling line 44.

The main circuit includes a water pump 6, which is driven by the engine via a belt 5, and sucks the cooling water out of the radiator 2 via a water outflow line 7, and feeds it for cooling purposes through the engine 1, from which it passes via a water inflow line 8 into the radiator 2. A vent line 43 leads from the line 8 to the expansion tank 42. Not shown, as unessential for the invention, is a cooling water controller, which ensures that a variation in the water temperature with the ending load and the engine speed is avoided.

In the secondary cooling circuit, there is a mechanical supercharger 9, which is likewise driven via the already mentioned belt 5. The secondary coolant circulates from the supercharger 9 via a delivery device 10, here an ejector. For the drive, this ejector is connected to the main cooling circuit, preferably downstream of the water pump 6. In the present case, a drive line 11 runs from the outlet on the pressure side of the water pump to the ejector.

The ejector feeds the coolant through a flow line 12 into the upper radiator tank 3 of the radiator 2, from the lower radiator tank 4 from which the then cooled water passes via the return line 13 to the supercharger 9.

In order to be independent of each other with respect to the operating temperature, the radiator tanks of the joint radiator for main circuit and secondary circuit are subdivided into two compartments each. This is effected by partitions 14, within the radiator tanks. In order that the secondary circuit can be filled with water in the first place, a compensating orifice 16, in the form of a simple opening, is arranged in the lower partition 15. The upper radiator tank 3 is connected to the expansion tank 42 via a second vent line 45.

In order to be able to control the operating temperature in the secondary cooling circuit, a bypass line 17 is arranged parallel to the radiator between flow line 12 and return line 13. At the junction of the flow line 12 and the bypass line 17, there is a thermostat valve 18. In this case, this is, for example, a short circuit-controlled controller, with which, while the engine is warming up after starting, the coolant only circulates in the supercharger, i.e., the flow line 12 to the radiator is blocked.

Fine control of the charge air temperature in the charge air line 19 to the engine, with respect to predetermined requirements, can be carried out if the thermostat valve 18 is controlled by an on-board computer 20. Input signals 21 and 22 to the computer 20 are in this case formed by operating variables, such as for example the measured charge air temperature and the control rod displacement of the injection pump, as the latter is symbolically represented.

Alternative to the compensating orifice 16 in the partition 15, it is quite possible also to make the partition 15 solid, i.e., without an opening. In this case, another possibility must be created, on the one hand for filling the secondary cooling circuit and on the other hand for removing the additional coolant extracted for the drive of the ejector from the main cooling circuit. This may be accomplished by a compensating line 23 connected between the lower radiator tank 4 in the main cooling circuit and the return line 13.

The mechanical supercharger to be cooled by means of secondary water is described below with reference to a spiral compressor. As well as the already known charge air line 19, via which the compressed, cooled combustion air is led into the engine, also shown in FIG. 1 is the intake line 24 for the fresh air. For the sake of clarity, these two lines 19, 24, and also the flow and return lines 12, 13, respectively, are shown in the simplest way.

Figure 3:
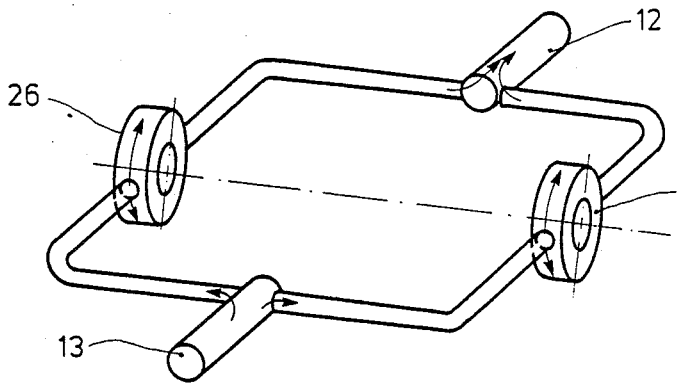
FIG. 3 is a diagrammatic view of coolant conduction in the supercharger.

Likewise shown diagrammatically, in FIG. 3, is the water conduction inside the supercharger 9. The water chambers 26, 26' are of an annular design and coolant is admitted to each chamber separately via a flow divider in the supercharger interior.

Figure 2:
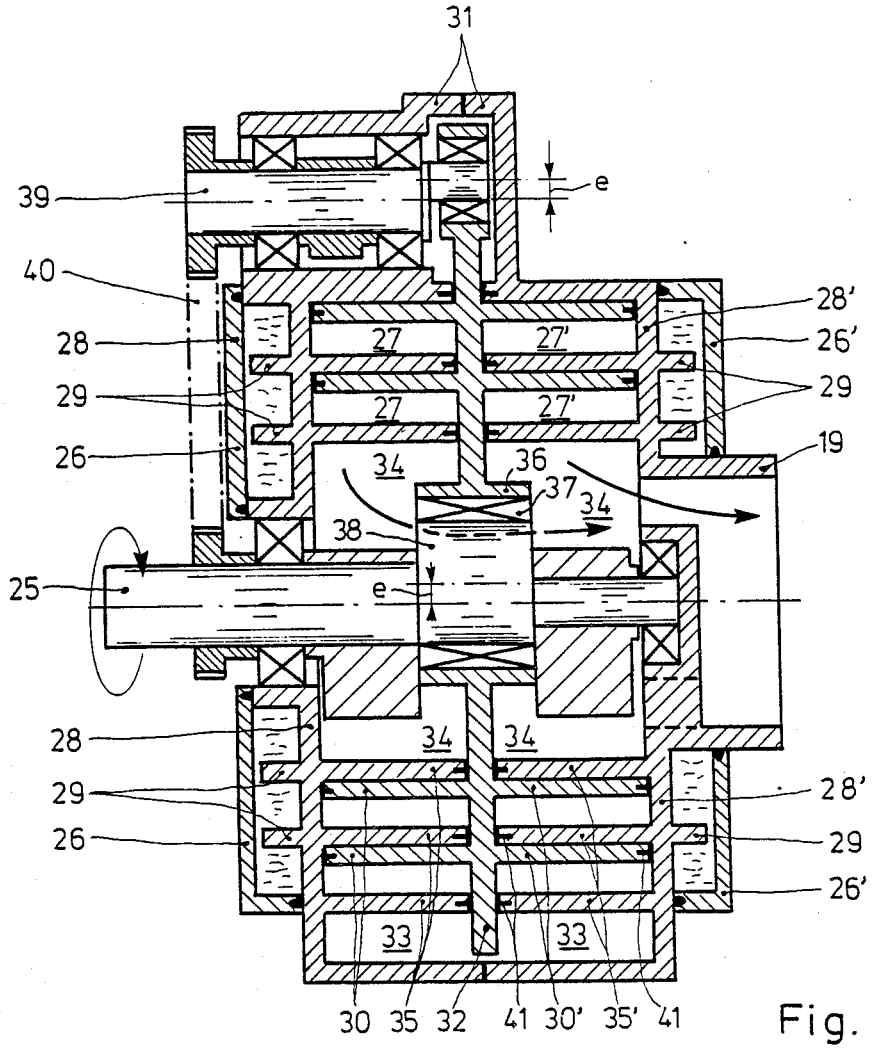
FIG. 2 is a longitudinal cross-sectional view through a mechanical supercharger to be cooled.

In FIG. 2, this supercharger is shown in longitudinal cross section. Such displacement machines, the mode of operation of which is known from the already cited DE 26 03 462 C2, are suitable in particular for supercharging internal-combustion engines, since they are distinguished by a virtually surge-free delivery of the working medium consisting of air or of a fuel-air mixture. During the operation of such a spiral supercharger, shown in FIG. 2, crescent shaped working spaces are enclosed along the delivery spaces 27, 27', between the displacer 32 and the webs 30, 30' of the delivery spaces, which working spaces extend from the inlet 33 through the delivery spaces to the outlet 34. At the same time, their volume reduces increasingly with a corresponding increase in the working medium pressure. The temperature of the delivered medium also increases at the same time.

To be specific, the supercharger has a two-part spiral housing 31. In both housing halves, the delivery spaces 27, 27' are in each case made in the side walls 28, 28' in the manner of a spiral-shaped slit. Between the delivery spaces remain the webs 30, 30'. The delivery spaces run from one inlet 33 each, arranged at the outer spiral end, to one outlet 34 each, arranged at the inner spiral end. The two inlets 33 and outlets 34 communicate with each other, in a way not shown, and are connected on one side to the intake line 24 (FIG. 1) and the charge air line 19.

The disk-shaped displacer 32 is held by a hub 36, with interposition of a rolling bearing 37, onto an eccentric disk 38 of the central drive shaft 25. A bar-shaped displacement body 35, 35' is arranged on both sides of the central disk. During the rotation of the drive shaft 25, each point of the displacer 32 thus executes a circular movement determined by the eccentricity of the eccentric disk 38. In order to make this movement reliably free from twisting, a second eccentric arrangement 39 is provided on the outer periphery of the displacer, for guidance. For angularly synchronous rotation, the two eccentric arrangements 25 and 39 are connected via a toothed belt 40.

The displacer bodies 35, 35' protrude in each case into the corresponding delivery spaces 27, 27' of the spiral housing 31. Like the delivery spaces, they too are of spiral-shaped design, to be precise in such a way that, during the circular movement, each displacer body virtually touches the inner and outer circumferential walls of the webs 30, 30' in the corresponding delivery space, at a continuously advancing seal line. At the free ends of the displacer bodies 35, 35' and of the webs 30, 30', spring-loaded seals 41 are inserted in from the side walls 28, 28' and from the displacer disk, respectively.

In order to remove or supply heat, annular water chambers 26, 26' are fixed by suitable means at the front ends of the supercharger 9. To increase the heat exchange surface, ribs 29, which protrude into the water chambers, are provided on the outside surface of the side walls 28, 28'. The heat retained in the webs, 30, 31 can be removed most efficiently if the ribs 29 are designed directly as an extension of the webs 30, 30'. The ribs likewise have a spiral-shaped profile.

Numerous modifications and variations of the present invention are possible in light of the above teachings. It is therefore to be understood that within the scope of the appended claims, the invention may be practiced otherwise than is specifically described herein.

I claim:

1. A water cooling system for an internal-combustion engine supercharged by means of a mechanical supercharger, comprising:

a main cooling circuit including a water pump, a radiator, and an internal-combustion engine;

said radiator including a compartmentalized part;

a secondary cooling circuit for the supercharger, which secondary cooling circuit is operated with the same working medium of the main cooling circuit;

means for driving the working medium in the secondary cooling circuit, which working medium in the secondary cooling circuit is fed from the main cooling circuit;

whereby said working medium in the secondary cooling circuit is cooled in the compartmentalized part of the radiator.

2. A water cooling system as claimed in claim 1, wherein the working medium in the secondary circuit is fed from a portion of the main cooling circuit that is downstream of the water pump.

3. A water cooling system as claimed in claim 1, wherein the radiator is a downdraft radiator having upper and lower radiator tanks.

4. A water cooling system as claimed in claim 3, wherein the radiator includes partitions in the upper and lower radiator tanks for defining the compartmentalized part.

5. A water cooling system as claimed in claim 4, wherein a compensating orifice is provided in the partition of the lower radiator tank.

6. A water cooling system as claimed in claim 1, further comprising a bypass line having a controlled thermostat valve therein arranged in the secondary cooling circuit parallel to the radiator.

7. A water cooling system as claimed in claim 1, wherein the driving means is an ejector.

8. A water cooling system as claimed in claim 7, further comprising a compensating line leading from the secondary cooling circuit, upstream of the supercharger, to the radiator, via which compensation line working medium equivalent to the quantity required for the drive of the ejector, may be returned to the main cooling circuit.

9. A water cooling system as claimed in claim 1, wherein the supercharger is a machine of the spiral type and which comprises:

a central drive shaft;

water chambers attached on both front ends of the supercharger;

side walls bounding delivery spaces of the supercharger; and ribs provided on the outer surfaces of the side walls, said ribs protrude into the water chambers.

10. A water cooling system as claimed in claim 9, further comprising webs bounding the delivery spaces in the radial direction, wherein the ribs are extensions of the webs.

11. A water cooling system as claimed in claim 1, wherein the driving means is an ejector.

12. A water cooling system as claimed in claim 11, wherein a compensating orifice is provided in the partition of the lower radiator tank.

* * * * *